US012421585B2

(12) United States Patent
Ros Yanez et al.

(10) Patent No.: US 12,421,585 B2
(45) Date of Patent: Sep. 23, 2025

(54) RAILROAD TANK CARS FORMED OF LOW-CARBON, HIGH TOUGHNESS, STEEL PLATES

(71) Applicant: ArcelorMittal, Luxembourg (LU)

(72) Inventors: Tanya Ros Yanez, Valparaiso, IN (US); Amar Kumar De, Munster, IN (US); Venkata Sai Ananth Challa, Woodridge, IL (US); Sandeep Abotula, Lemont, IL (US)

(73) Assignee: ArcelorMittal, Luxembourg (LU)

( * ) Notice: Subject to any disclaimer, the term of this patent is extended or adjusted under 35 U.S.C. 154(b) by 879 days.

(21) Appl. No.: 17/297,354

(22) PCT Filed: Nov. 20, 2019

(86) PCT No.: PCT/IB2019/059989

§ 371 (c)(1),
(2) Date: May 26, 2021

(87) PCT Pub. No.: WO2020/115594

PCT Pub. Date: Jun. 11, 2020

(65) Prior Publication Data

US 2022/0025496 A1 Jan. 27, 2022

(30) Foreign Application Priority Data

Dec. 7, 2018 (WO) ..... PCT/IB2018/059773

(51) Int. Cl.

| | |
|---|---|
| ***C22C 38/46*** | (2006.01) |
| ***B61D 5/00*** | (2006.01) |
| ***B61D 17/04*** | (2006.01) |
| ***C21D 1/28*** | (2006.01) |
| ***C21D 6/00*** | (2006.01) |
| ***C21D 8/02*** | (2006.01) |

(Continued)

(52) U.S. Cl.

CPC ..... *C22C 38/46* (2013.01); *B61D 5/00* (2013.01); *B61D 17/041* (2013.01); *C21D 1/28* (2013.01);

(Continued)

(58) Field of Classification Search

None

See application file for complete search history.

(56) References Cited

U.S. PATENT DOCUMENTS 3,277,843 A * 10/1966 Horner ..... B61D 5/06 105/183
2021/0301365 A1* 9/2021 So ..... C22C 38/12

FOREIGN PATENT DOCUMENTS

CN 104480393 A * 4/2015
CN 104831165 A * 8/2015
WO WO-2009082091 A1 * 7/2009 ..... C21D 8/0426

OTHER PUBLICATIONS

Machine Translation of CN-104480393-A (Year: 2015).*

(Continued)

*Primary Examiner* — John A Hevey

(74) *Attorney, Agent, or Firm* — Davidson Kappel LLC

(57) ABSTRACT

A railroad tank car formed from steel alloy plates having improved toughness and puncture resistance. The steel alloy plates include a steel alloy including in wt. %: C: 0.1-0.15; Mn: 1.0-1.65; Si: 0.15-0.40; Al: 0.015-0.06; Mo: 0.1-0.3; Ni: 0.1-0.25; Nb: 0.015-0.045; Ti: up to 0.02; Cr: up to 0.22; V: up to 0.08; Cu: up to 0.35; P: max 0.025; S: max 0.015; and N: 0.004-0.01. The alloy plates may have been normalized for 30 minutes at 900° C. The alloy plates may have a tensile strength of at least 560 MPa; a yield strength of at least 345 MPa; a total elongation of at least 22%; a CVN impact toughness of at least 135.5J at −34.4° C.; a CVN impact toughness of at least 122J at −45.5° C. The alloy plates may have a ferrite-bainite microstructure, with 10% or less pearlite. The alloy plates of the inventive railroad tank car may have an absence of any banded ferrite-pearlite/martensite structure.

11 Claims, 8 Drawing Sheets

(51) Int. Cl. *C21D 9/46*
(2006.01) *C22C 38/00*
(2006.01) *C22C 38/02*
(2006.01) *C22C 38/04*
(2006.01) *C22C 38/06*
(2006.01) *C22C 38/42*
(2006.01) *C22C 38/44*
(2006.01)

(52) U.S. Cl.
CPC ..... *C21D 6/004* (2013.01); *C21D 6/005* (2013.01); *C21D 6/008* (2013.01); *C21D 8/0205* (2013.01); *C21D 8/0226* (2013.01); *C21D 8/0263* (2013.01); *C21D 9/46* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C21D 2211/002* (2013.01); *C21D 2211/005* (2013.01); *C21D 2211/009* (2013.01)

(56) References Cited

OTHER PUBLICATIONS

Machine Translation of CN-104831165-A (Year: 2015).*
See Search Report of PCT/IB2019/059989 dated Dec. 18, 2019.
M. Manohar, W.E. Heitmann, "Effects of Niobium, Titanium and Nitrogen on the Microstructure and Mechanical Properties of Normalized Tank Car Steel Plates", Materials Science and Technology, Detroit, (Sep. 20, 2007).
R.L. Bodnar, F. Hamad, C. Penniston, S. Roysum, "As-Rolled Plate Product With Improved Yield Strength, Toughness, and Weldability for Pressurized Railroad Tank Cars", Materials Scirnce and Tachnology, Detroit, (Sep. 20, 2007), pp. 37-52.
Arunim Ray, "Niobium microalloyed rail steels", Department of Materials Science and Metallurgy, University of Cambridge, Cambridge, (Apr. 30, 2017), pp. 1-166.
Klaus Hulka, "The Role of Niobium in Low Carbon Bainitic HSLA Steel", (Dec. 31, 2005), Niobium Products Company GmbH, Dusseldorf, URL: https://www.phase-trans.msm.cam.ac.uk/2005/LINK/10.pdf , (Jul. 17, 2019).
"Effect of Nb on Weld Metal Toughness in Tank Car Steels", 1995 ASME International Mechanical Engineering Congress and Exposition, RTD—vol. 10, ed. R.R. Newman, Nov. 12-17, 1995, San Francisco, CA, pp. 109-117.
Effects of Niobium, Titanium and Nitrogen on the Microstructure and Mechanical Properties of Normalized Tank Car Steel Plates, Materials Science and Technology (2007).
C. Shah and P. Nash, 45th Mechanical Working and Steel Processing Conference Nov. 10-12, 2003.
P. J. Kyed, M. Manohar and R. L. Bodnar, "Effects of Niobium Content and Heat Treatment on the Microstructure and Mechanical Properties of Railroad Pressure Tank Car Steel Plates," 45th Mechanical Working and Steel Processing Conference Proceedings, ISS, vol. 41, 2003, pp. 43-55.

* cited by examiner

RAILROAD TANK CARS FORMED OF LOW-CARBON, HIGH TOUGHNESS, STEEL PLATES

FIELD OF THE INVENTION

The present invention relates to railroad tank cars and more specifically to railroad tank cars produced from steel alloy plates. Most specifically the invention relates to railroad tank cars produced from steel alloy plates having improved toughness and puncture resistance.

BACKGROUND

Historically railroad tank car manufacturers have been using TC 128 Gr B steel plates for making tank car heads and occasionally ASTM A516-70 steel plates depending on carrier contents. The steel plates are formed in to tank car heads either in ambient temperature after normalizing or at an elevated temperature (slightly above the Ar3 temperature) and then normalized. The full tank car body is then given a post weld heat treatment (PWHT) at 600-650° C. for an hour. So, the specified material properties are to be guaranteed in normalized and PWHT condition.

Tables 1 and 2 show the chemical and mechanical property requirements for the current TC 128 Gr B steel. Traditionally, the steel manufacturers have been using high C and Mn in order to meet the minimum tensile strength requirements as higher carbon equivalence (CE) guarantees higher pearlite contents and thereby higher tensile strength. Microalloying with Nb has rarely been opted or encouraged because of concerns of HAZ (Heaty Affected Zone) and weld metal toughness. Table 1 shows the chemical composition of current TC128 Gr B steel used by tank car manufactures in wt. %.

TABLE 1

| C max | Mn | P max | S max | Si | Cu max | Ni | Cr | Mo | V max | Ti max | Al | Nb max | N max |
|---|---|---|---|---|---|---|---|---|---|---|---|---|---|
| 0.24 | 1.00-1.65 | 0.025 | 0.015 | 0.15-0.40 | 0.35 | Cu + Ni + Cr + Mo ≤ 0.65 | | | 0.08 | 0.02 | 0.015-0.06 | 0.05* | 0.01 |

*With customer's consent

Ceq = C + Mn/6 + (Cr + Mo + V)/5 + (Cu + Ni)/15, Ceq (max %): 0.53

Nb + V + Ti (max %): 0.11; Ti/N (max ratio): 4.0

Table 2 shows specified mechanical properties in current TC128 Gr B steel used by tank car manufactures. 2" GL is the 2-inch gauge length of the tensile specimen. The minimum longitudinal impact energy is 20.3 J at −45.5° C. and minimum transverse impact energy is 20.3 J at −34.4° C.

TABLE 2

| Yield Strength | Tensile Strength | Total Elongation, (2" GL), min | CVN Impact Tests (J) Longitudinal | CVN Impact Tests (J) Transverse |
|---|---|---|---|---|
| 345 MPa | 560-695 MPa | 22% | Min 20.3 @ −45.5 C. | Min 20.3 @ −34.4 C. |

Because of use of high C, Mn and other alloying elements the normalized microstructures of TC 128 Gr B steel plates often indicate a heavily banded ferrite-pearlite microstructure with streaks of martensite within the bands. FIG. 1 is a photomicrograph of the normalized microstructure of a TC 128 Gr B steel plate of the prior art. The streaks of martensite 1 can easily be seen. The banded structure results in inconsistent and low impact toughness in the final tank car head. The upper shelf Charpy energy is also low due to high carbon content. FIG. 2 is plot of the longitudinal CVN impact energy versus heat number for samples taken from tank car heads formed with TC 128 Gr B steel of the prior art. The data reveals poor impact toughness values. This has been a cause for a growing safety concern for the tank car industry.

Table 3 indicates the composition of the alloy of the photomicrograph of FIG. 1 and the data of FIG. 2 in weight percent. Furthermore, it is the alloy used hereinafter as a comparison of the prior art TC 128 Gr B presently in use in the industry.

TABLE 3

| C | Mn | P | S | Si | Cu | Ni | Cr | Mo | V | Al |
|---|---|---|---|---|---|---|---|---|---|---|
| 0.22 | 1.36 | 0.012 | 0.003 | 0.35 | 0.02 | 0.01 | 0.16 | 0.06 | 0.06 | 0.034 |

Recently, in the context of several tank car accidents, the Association of American Railroads (AAR) has mandated newer safety regulations for tank cars requiring tougher and more puncture-resistant steels. Thus, there is a need in the art for railroad tank cars produced from steels that guarantee higher puncture resistance.

SUMMARY OF THE INVENTION

The present invention relates to a railroad tank car formed of steel alloy having improved toughness and puncture resistance. The railroad tank car is formed of steel alloy plate which comprises a steel alloy including in wt %: C: 0.1-0.15; Mn: 1.0-1.65; Si: 0.15-0.40; Al: 0.015-0.06; Mo: 0.1-0.3; Ni: 0.1-0.25; Nb: 0.015-0.045; Ti: up to 0.02; Cr: up to 0.22; V: up to 0.08; Cu: up to 0.35; P: max 0.025; S: max 0.015; and N: 0.004-0.01. The alloy plate may have been normalized for 30 to 60 minutes at 900° C. The alloy plate may have a tensile strength of at least 560 MPa; a yield strength of at least 345 MPa; an elongation of at least 22%; a CVN impact toughness of at least 135.5 J at −34.4° C.; a CVN impact toughness of at least 122 J at −45.5° C. The alloy plate may have a ferrite-bainite microstructure with 10% or less pearlite, preferably 5% or less, and most preferably 1% or less pearlite. The inventive alloy plate may have an absence of any banded ferrite-pearlite/martensite structure.

The steel alloy plate may contain 0.018 wt. % Nb and may have a tensile strength of at least 575 MPa; a yield strength of at least 425 MPa; an elongation of at least 33%; a CVN impact toughness of at least 176.25 J at −34.4° C.; and a CVN impact toughness of at least 203.3 J at −45.5° C.

The steel alloy plate may contain 0.032 wt. % Nb and may have a tensile strength of at least 580 MPa; a yield strength of at least 460 MPa; an elongation of at least 33%; a CVN impact toughness of at least 156 J at −34.4° C.; and a CVN impact toughness of at least 128.8 J at −45.5° C.

The steel alloy plate may contain 0.045 wt. % Nb. The steel alloy plate may have been subjected to a post weld heat treatment of 30-60 mins at 600-650° C.

DETAILED DESCRIPTION OF THE INVENTION

Figure 1:
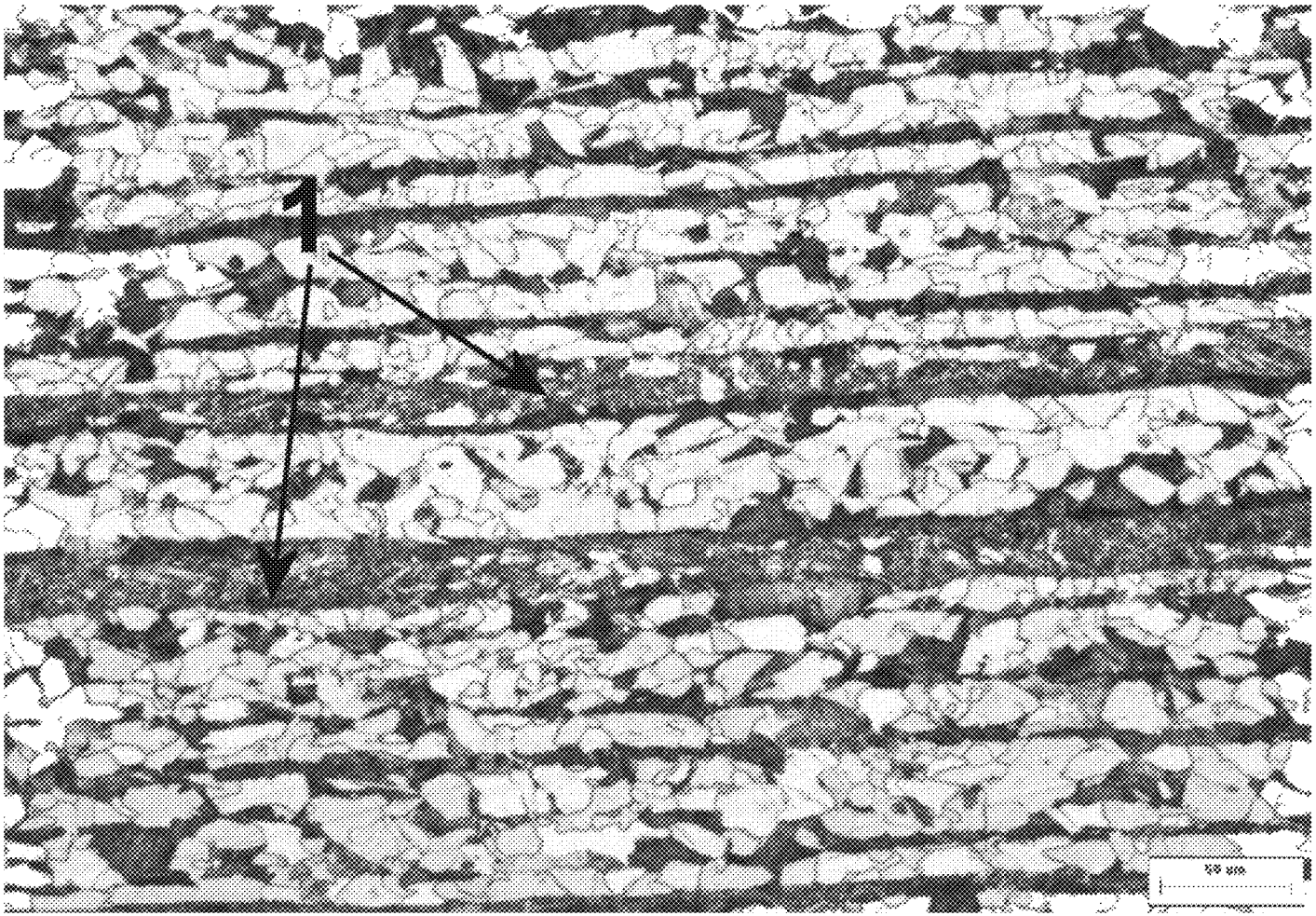
Fig. 1 (prior art)
FIG. 1 is a photomicrograph of the normalized microstructure of a TC 128 Gr B steel plate of the prior art.
Figure 2:
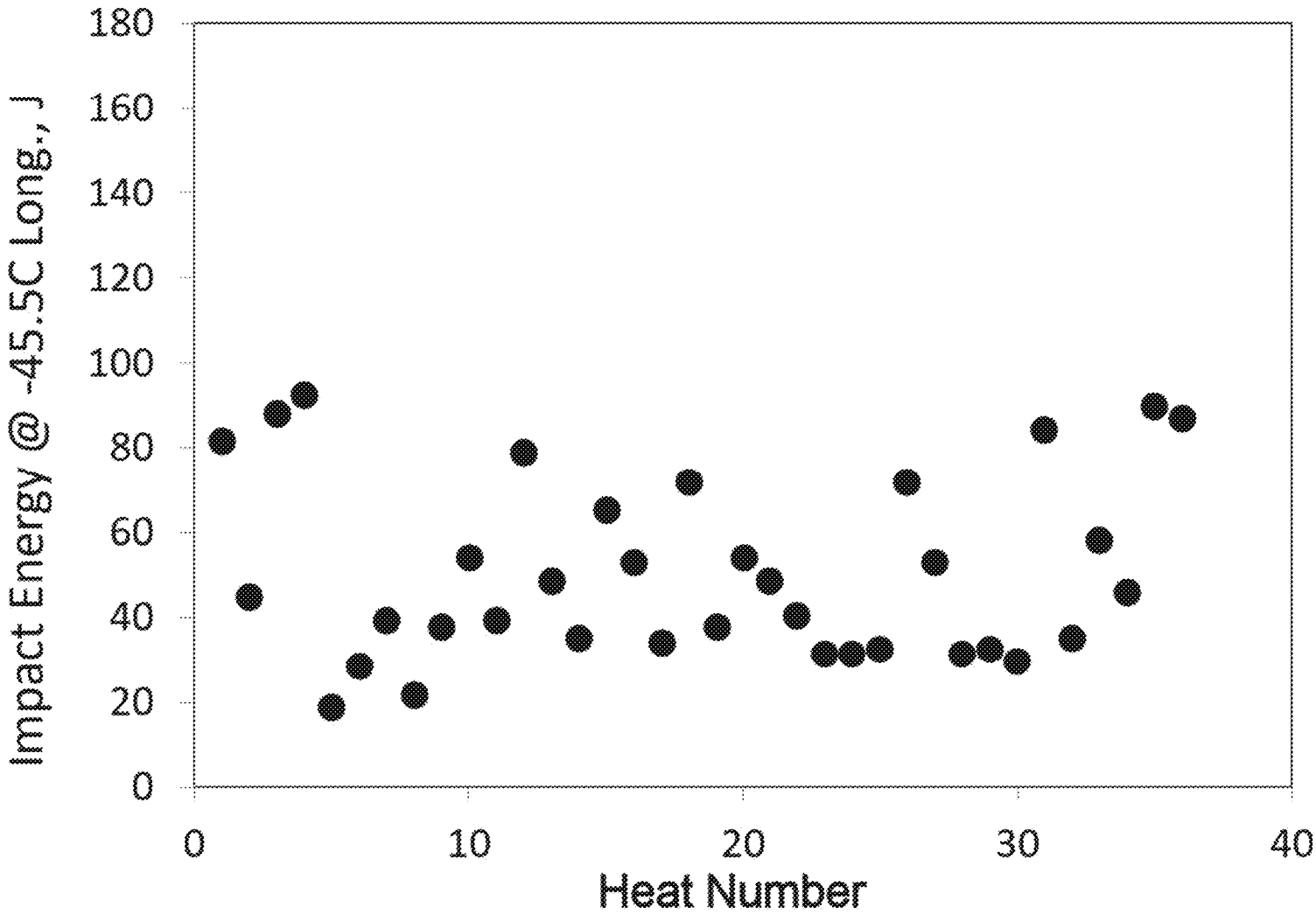
Fig. 2 (prior art)
FIG. 2 is plot of the longitudinal CVN impact energy versus heat number for samples taken from tank car heads formed with TC 128 Gr B steel of the prior art.

The present invention relates to inventive railroad tank cars formed of plates of a new TC 128 chemistry within the stipulated compositional limits of TC 128 to significantly improve the toughness values. The newer chemistry significantly lowers the carbon content so that both the upper shelf as well as transition temperature is improved. Any loss in tensile strength due to the reduction of carbon is mitigated by (i) inducing a finer ferrite grain size due to addition of Nb, (ii) changes of microstructure from a predominantly ferrite-pearlite to ferrite-bainite through addition of Mo and (iii) some low-temperature precipitation contribution through alloying with Nb and Mo.

Significantly, the prior art teaches away from adding Nb to tank car alloys. For example, the journal article "Effect of Nb on Weld Metal Toughness in Tank Car Steels", 1995 ASME International Mechanical Engineering Congress and Exposition, RTD-Vol. 10, ed. R. R. Newman, Nov. 12-17, 1995, San Francisco, CA, pp. 109-117 teaches:

- Nb was shown to be detrimental to TC128 Grade B weld metal toughness in the stress relived conditions;
- 0.03% Nb steel did not meet the stress relieved toughness requirement with any flux-wire combination of this study; and
- acceptable weld metal toughness in the stress relieved condition was obtained only with the Nb-free steels.

Further, "Effects of Niobium, Titanium and Nitrogen on the Microstructure and Mechanical Properties of Normalized Tank Car Steel Plates", Materials Science and Technology (MS&T) 2007 Sep. 16-20, 2007, Detroit, Michigan, STEEL: 4th International Symposium on Railroad Tank Cars teaches:

- TC128 Grade B steel containing no Nb or Ti, exhibited the best toughness. CVN toughness measured at both −34° C. and at the upper shelf, it was found that the base TC128 Grade B steel containing no Nb or Ti, exhibited the best toughness.
- The combination addition of Nb and Ti to TC128 Grade B steel did not provide any meaningful benefit to the mechanical properties in the normalized condition at both N levels tested.

Again, Nb was shown to be detrimental to TC128 Grade B simulated HAZ toughness in C. Shah, "Effect of Nb additions on Welding Heat Affected Zone (HAZ) Toughness of 0.2 wt % C Ferrite-Pearlite Steels," MS Thesis in Metallurgical and Materials Engineering, IIT Chicago 2002. Also C. Shah and P. Nash, 45th Mechanical Working and Steel Processing Conference Nov. 10-12, 2003.

In another example, adding Nb to laboratory heats of TC128 Grade B did not provide meaningful benefits to the mechanical properties of base metal: strength and toughness (especially upper shelf) P. J. Kyed, M. Manohar and R. L. Bodnar, "Effects of Niobium Content and Heat Treatment on the Microstructure and Mechanical Properties of Railroad Pressure Tank Car Steel Plates," 45th Mechanical Working and Steel Processing Conference Proceedings, ISS, Vol. 41, 2003, pp. 43-55.

Contrary to all of these (and more) prior art teachings, the present inventors have determined that the addition of Nb at low levels does not interfere with HAZ toughness when, as in the instant invention, the carbon was significantly reduced. The lowering of the carbon level improves the weldability and HAZ toughness and reduces the PWHT time significantly thereby reducing the operating costs.

Broadly the steel alloy plates of the inventive railroad tank cars include in wt %: C: 0.1-0.15; Mn: 1.0-1.65; Si: 0.15-0.40; Al: 0.015-0.06; Mo: 0.1-0.3; Ni: 0.1-0.25; Nb: 0.015-0.045; Ti: up to 0.02; Cr: up to 0.22; V: up to 0.08; Cu: up to 0.35; P: max 0.025; S: max 0.015; and N: 0.004-0.01. Table 4 shows the more preferred ranges of the chemical compositions of the steel alloy plates of the inventive railroad tank cars.

TABLE 4

| | C | Mn | P | S | Si | Al | Cr | Mo | Ni | Nb | Ti | V | Cu | N |
|---|---|---|---|---|---|---|---|---|---|---|---|---|---|---|
| Min | 0.1 | 1.3 | — | — | 0.28 | 0.02 | — | 0.1 | 0.1 | 0.015 | 0.001 | — | — | 0.004 |
| Max | 0.15 | 1.5 | 0.02 | 0.005 | 0.35 | 0.04 | 0.22 | 0.3 | 0.18 | 0.045 | 0.002 | 0.02 | 0.15 | 0.006 |

Three different compositions varying only in Nb contents were melted in laboratory vacuum induction furnace and cast in 50 kg ingots. The compositions of the three alloys are presented in Table 5. The cast billets (125×125×250 mm in sizes) were hot rolled using industrial practices to 22 mm thick plates and then normalized. Normalization is an annealing process applied to ferrous alloys to give the material a uniform fine-grained structure and to avoid excess softening in steel. It involves heating the steel to 20-50° C. above its upper critical point, soaking it for a short period at that temperature and then cooling it in air to room temperature.

TABLE 5

| | C | Mn | P | S | Si | Cu | Ni | Mo | Al | Nb | N |
|---|---|---|---|---|---|---|---|---|---|---|---|
| Nb-018 | 0.12 | 1.44 | 0.01 | 0.001 | 0.345 | 0.144 | 0.149 | 0.3 | 0.04 | 0.018 | 0.005 |
| Nb-036 | 0.121 | 1.5 | 0.002 | 0.002 | 0.35 | 0.143 | 0.15 | 0.29 | 0.04 | 0.036 | 0.006 |
| Nb-045 | 0.116 | 1.4 | 0.01 | 0.002 | 0.344 | 0.146 | 0.148 | 0.3 | 0.028 | 0.045 | 0.006 |

Figure 3:
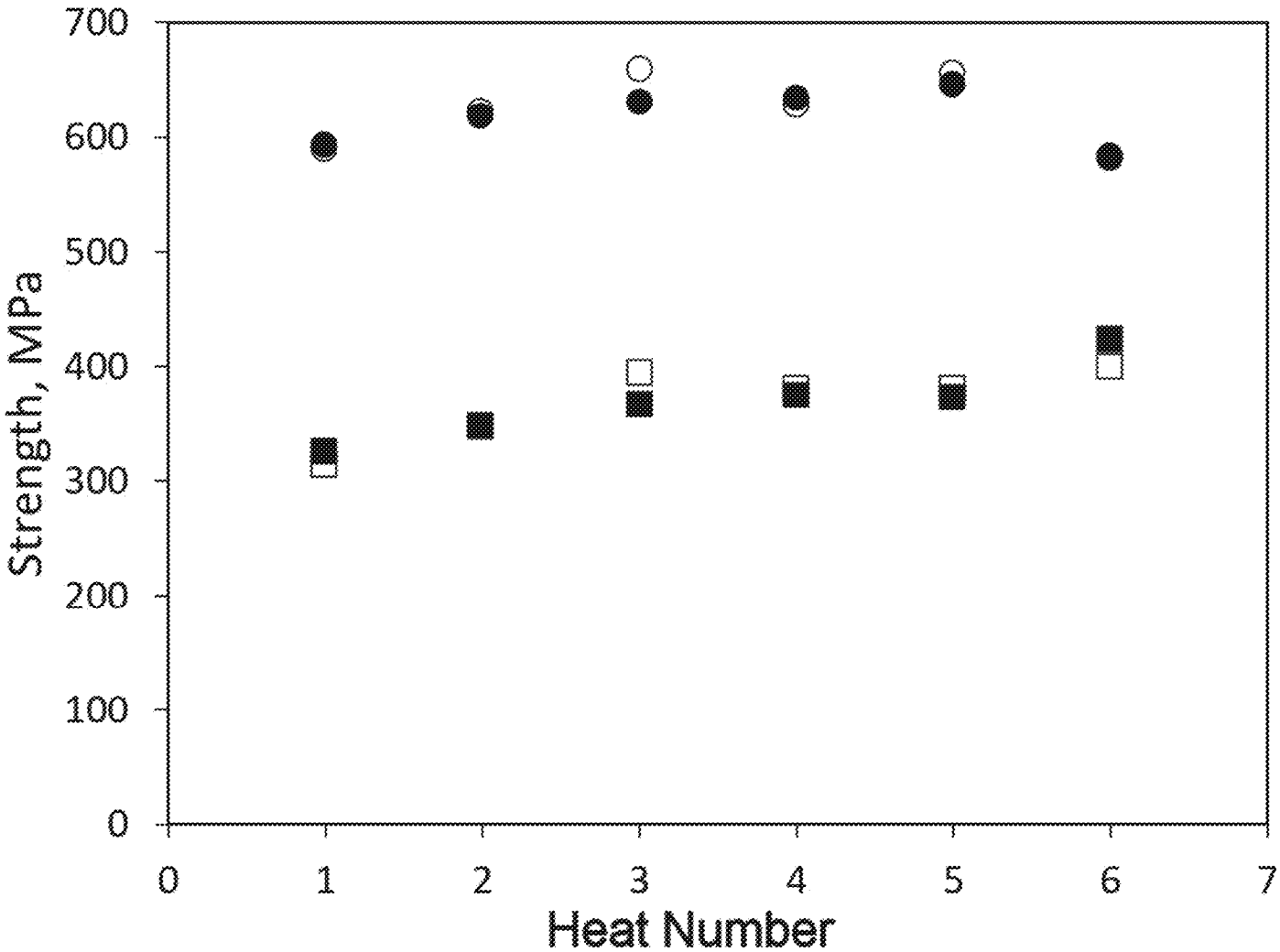
FIG. 3 is a plot of tensile properties of the steel plates of the inventive railroad tank car as a function of normalizing time at 900° C. vs the heat number.
Figure 4:
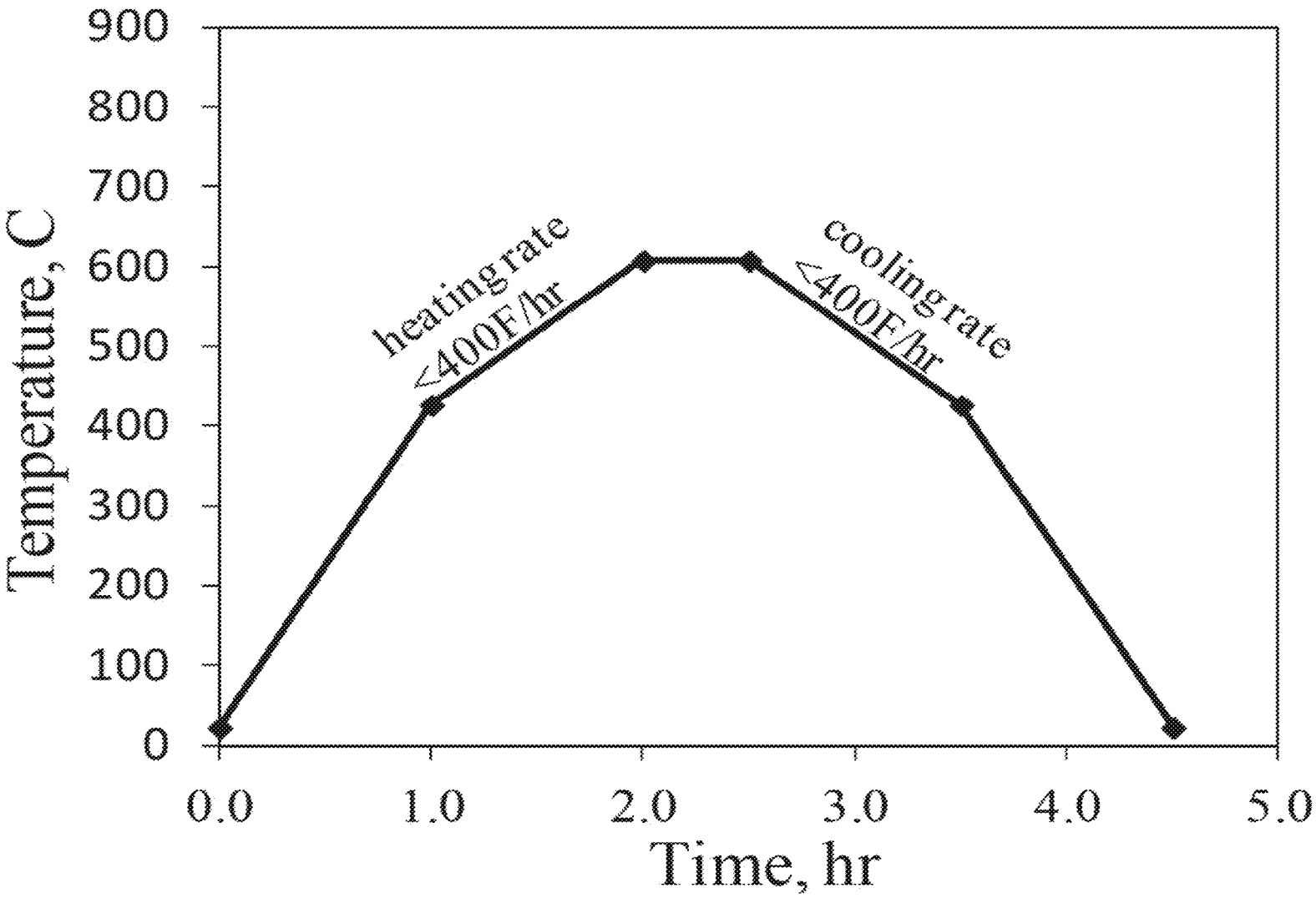
FIG. 4 plots the temperature vs time for the industry standard PWHT for TC 128 steels.

The inventors determined that normalizing for 30 mins at 900° C. resulted in about the same tensile properties as normalizing for 60 mins at 900° C. Therefore, all the steel alloy plates of the inventive railroad tank cars disclosed hereinafter were normalized at 900° C. for 30 minutes. FIG. 3 is a plot of tensile properties of the steel alloy plates of the inventive railroad tank cars as a function of normalizing time at 900° C. vs the heat number. The symbols ■ and ● represent the Yield Strength (YS) and ultimate Tensile Strength (TS) respectively for normalization for 60 minutes at 900° C. The symbols and represent the Yield Strength (YS) and ultimate Tensile Strength (TS) respectively for normalization for 30 minutes at 900° C. FIG. 3 indicates that a 30-minute normalizing time is as effective as 60 minutes. Subsequent to normalizing, the plates were given a post weld heat treatment (PWHT) of 30-60 mins at 600-650° C. Industrial trials were conducted as per TC 128 PWHT cycle recommendations for 1 hour. FIG. 4 plots the temperature vs time for the industry standard PWHT for TC 128 steels.

Mechanical Properties

The transverse tensile properties of the steel alloy plates of the inventive railroad tank cars with various Nb contents are shown in Table 6 in normalized and PWHT condition. In all Nb levels, the minimum tensile strength meets the required specification for TC 128. The yield strength shows a maximum at 0.032 wt. % of Nb.

TABLE 6

| Nb, wt. % | Yield Strength MPa | Tensile Strength MPa | Elongation (2" GL) % |
|---|---|---|---|
| 0.018 | 427.5 | 575.0 | 33 |
| 0.032 | 460.0 | 580.0 | 33 |
| 0.045 | 376.0 | 559.0 | 38 |

Figure 5:
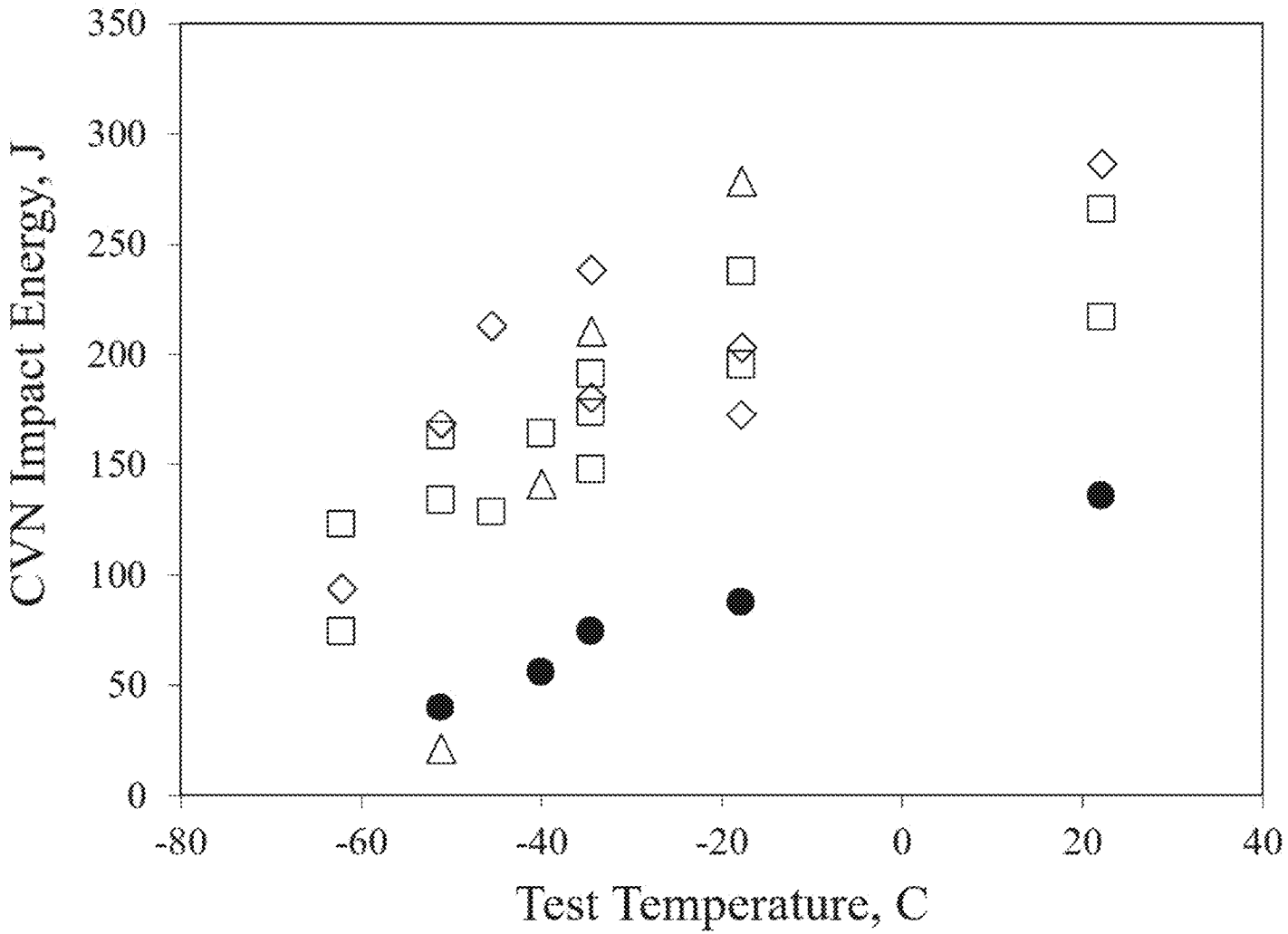
FIG. 5 plots the CVN impact toughness of the steel plates of the inventive railroad tank car and a conventional TC 128 Gr B steel vs test temperature.

FIG. 5 plots the CVN impact toughness of the steel alloy plates of the inventive railroad tank cars and a conventional TC 128 Gr B steel vs test temperature. Symbols ◇, □ and Δ represent the CVN impact energy for inventive steels with 0.018, 0.032 and 0.045 Nb content, respectively. The symbol ● represents the prior art TC 128 Gr B steel. It can be seen that the steel alloy plates of the inventive railroad tank cars exhibit excellent impact toughness values at all test temperatures. The steel alloy plates of the inventive railroad tank cars show a significant increase in the toughness values including upper shelf compared with that of prior art TC 128 Gr B steel. The Nb content variations between 0.02-0.045 wt. % did not have a significant impact on the upper shelf energy. Table 7 lists the CVN impact toughness of the steel alloy plates of the inventive railroad tank cars and a conventional TC 128 Gr B steel vs test temperature as plotted in FIG. 5.

TABLE 7

| Temperature | CVN Impact Energy (J) in Normalized and PWHT condition | | | |
|---|---|---|---|---|
| (° C.) | 0.02% Nb | 0.035% Nb | 0.045% Nb | TC 128 Gr B |
| 22.2 | 286 | 241.3 | | 135.5 |
| −17.78 | 187.1 | 215.5 | 279.3 | 86.7 |
| −34.4 | 180.32 | 160 | 210.1 | 74.5 |
| −40 | 238.6 | 177.6 | 141 | 55.5 |

Figure 6:
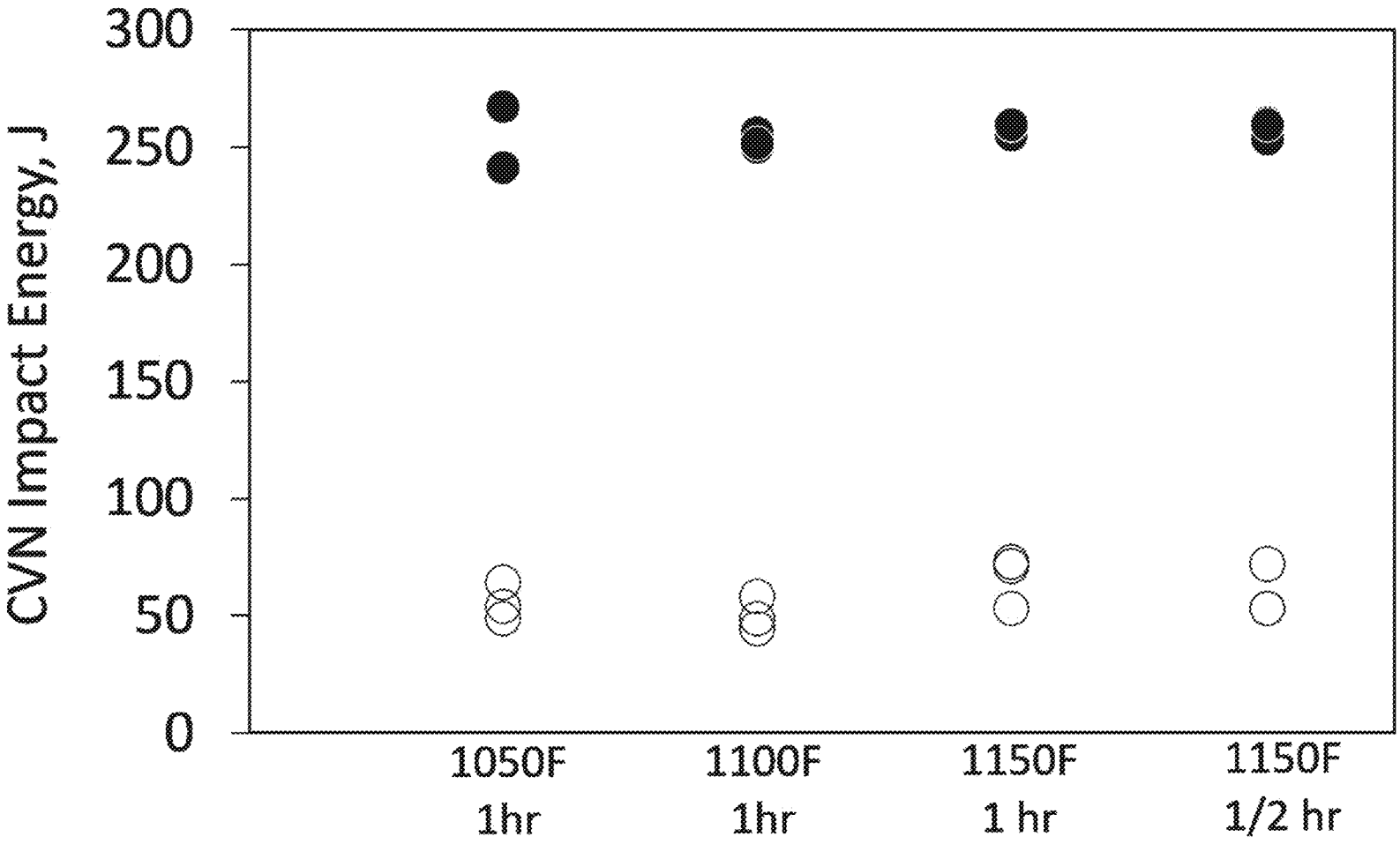
FIG. 6 plots the CVN impact toughness vs PWHT scheme from industrial trials of 0.032 Nb steel plates of the inventive railroad tank car compared with conventional TC128 Gr. B.
Figure 7A:
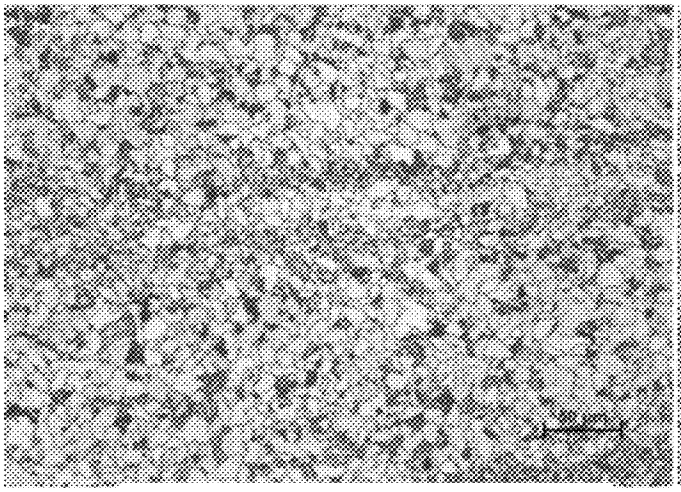
FIG. 7A is a photomicrograph showing the microstructure of normalized and PWHT of the steel plates of the inventive railroad tank car with 0.018 wt. % Nb.
Figure 7B:
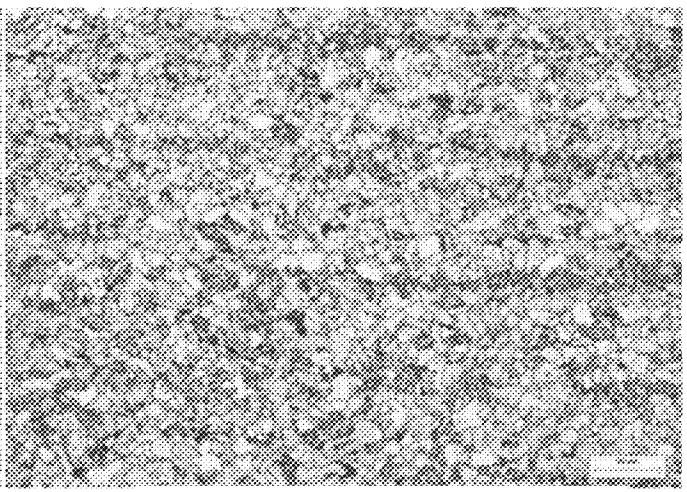
FIG. 7B is a photomicrograph showing the microstructure of normalized and PWHT of the steel plates of the inventive railroad tank car with 0.032 wt. % Nb.
Figure 7C:
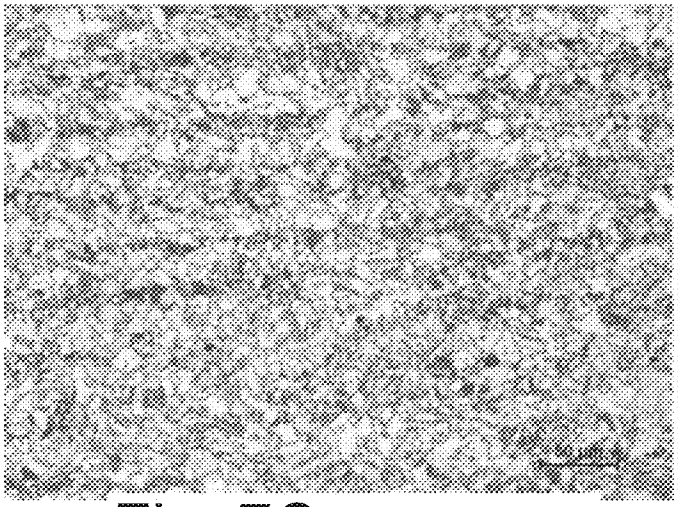
FIG. 7C is a photomicrograph showing the microstructure of normalized and PWHT of the steel plates of the inventive railroad tank car with 0.045 wt. % Nb.
Figure 7D:
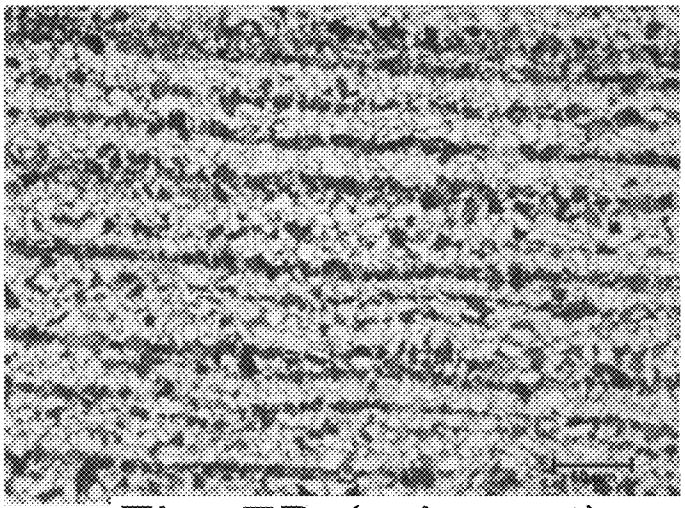
Fig. 7D (prior art)
FIG. 7D is a photomicrograph showing the microstructure of normalized and PWHT of steel plates of prior art railroad tank cars TC 128 Gr B steel.
Figure 8:
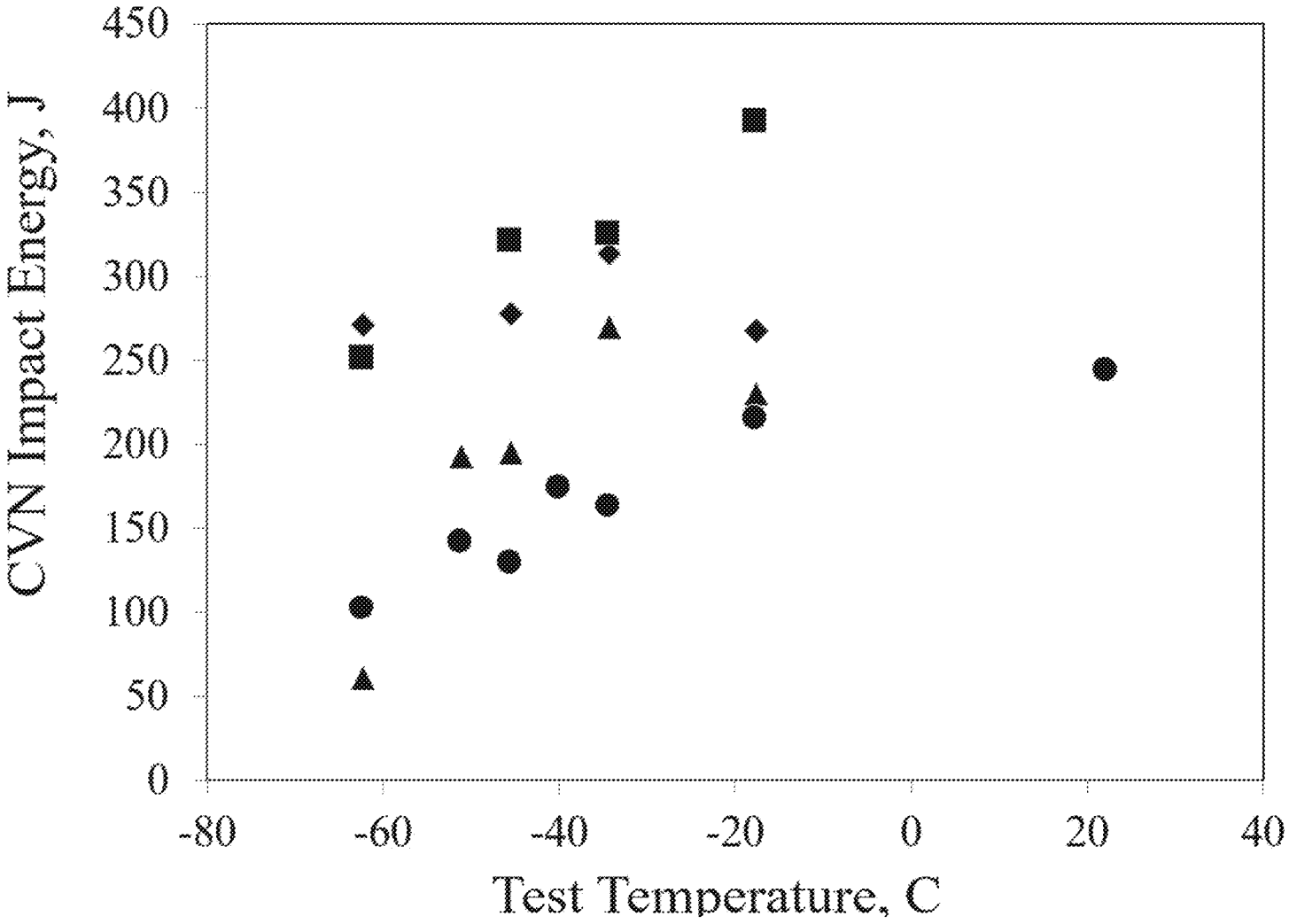
FIG. 8 is a plot of the transverse CVN impact toughness of the CGHAZ of the steel plates of the inventive railroad tank car at the three different niobium levels and the base metal of the steel vs temperature.

FIG. 6 plots the CVN impact toughness vs PWHT scheme from industrial trials of 0.032 Nb steel alloy plates of the inventive railroad tank cars compared with conventional TC128 Gr. B. It is evident that the impact properties were similar for PWHT of 30 min and 1 hour at 621° C. Regardless of temperature and time, the impact properties were similar in all the conditions for the 0.032 Nb steel alloy plates of the inventive railroad tank cars. The symbol ● represents the impact energy of 0.032 Nb steel alloy plates of the inventive railroad tank cars, and ○ represent prior art TC 128 Gr B steel. Table 8 lists the CVN impact toughness of the industrial trail 0.032 Nb steel alloy plates of the inventive railroad tank cars and conventional TC 128 Gr B steel vs test temperature at −34.4° C. as plotted in FIG. 6.

TABLE 8

| | CVN Impact Energy (J) in PWHT condition @−34.4 C. | |
|---|---|---|
| PWHT Condition | Invented Steel (0.032% Nb) | Conventional TC 128 Gr B |
| 565° C. (1050° F.) for 1 hr | 259 | 57 |
| 593° C. (1100° F.) for 1 hr | 252 | 54.2 |
| 621° C. (1150° F.) for 1 hr | 257.6 | 65 |
| 621° C. (1150° F.) for 30 min | 257.6 | 60 |

Microstructure

The microstructures of normalized and PWHT steel alloy plates of the inventive railroad tank cars (with 0.018, 0.032 and 0.045 Nb content, respectively) are shown in FIGS. 6A to 6C. The microstructure of the prior art TC 128 Gr B steel is shown in FIG. 6D. All three examples of the steel alloy plates of the inventive railroad tank cars showed a mixed ferrite-bainite microstructure with 10% or less pearlite, preferably 5% or less pearlite, most preferably 1% or less pearlite. The fraction of bainite appears to increase and the ferrite grains become more acicular type with increasing Nb content. In contrast, the microstructure of the prior art TC 128 Gr B steel showed a banded ferrite-pearlite/martensite structure with ferrite grains being mostly polygonal.

Weldability Studies

Since microalloying with Nb was an integral part of the alloy design, a weldability evaluation was carried out to examine the CGHAZ (coarse grain heat affected zone) toughness for the three steels with different Nb contents. It is to be noted that tank car manufacturers are conservative about niobium's influence on the HAZ and weld metal toughness, especially with the typical higher carbon levels in prior art TC 128 steel alloys. The present inventors therefore examined the microalloying influence on the HAZ toughness for Nb levels up to 0.045 wt. %. Laboratory heats with Nb contents of 0.018, 0.032 and 0.045 wt. % were processed to 22 mm thick plates and then normalized for welding study.

FIG. 7 plots the transverse CVN impact toughness of the CGHAZ of the steel alloy plates of the inventive railroad tank cars at the three different niobium levels and the base inventive steel vs temperature. The symbol ● represents the 0.032 Nb alloy base metal CVN impact toughness. The symbols ♦, ■, and ▲ represent the CVN impact toughness of the HAZ of steel alloy plates of the inventive railroad tank cars with Nb contents of 0.018, 0.032 and 0.045 wt. % respectively. It should be noted that the HAZ toughness was found to be superior to that observed for the base metal. It can also be seen that Nb in excess of 0.03 wt. % did not contribute much to the CGHAZ toughness in the new steels.

The CGHAZ toughness of the steel alloy plates of the inventive railroad tank cars was tested after a high heat input welding process (110-120 kJ/in) employing only two passes, one pass each side. A two-pass submerged arc welding (SAW) at high heat inputs (~105 kJ/inch) is considered to be the most conservative test condition that the new steel could be subjected to for tank car application. Steel alloy plates of the inventive railroad tank cars (as listed in Table 9) were formed. Each plate edge was beveled 40 degrees on each side (front/back) as per welding specification and welded using an LA-85 consumable and 882 flux at heat inputs between 93-105 kJ/inch. An interpass temperature of 150° C. was maintained. For comparison, a commercially produced TC 128 plate was also welded at similar welding parameters. The plates were subsequently heat treated at 600° C. for 30 minutes (as per industry PWHT standards for tank cars).

TABLE 9

| C | Mn | P | S | Si | Cu | Ni | Cr | Mo | V | Ti | Al | Nb | B | N | Ca |
|---|---|---|---|---|---|---|---|---|---|---|---|---|---|---|---|
| 0.12 | 1.49 | 0.01 | 0.003 | 0.327 | 0.142 | 0.14 | 0.03 | 0.284 | 0.003 | 0.002 | 0.034 | 0.029 | 0.0002 | 0.007 | 0.0031 |

The HAZ toughness for the steel alloy plates of the inventive railroad tank cars which was welded by the SAW process was excellent at all test temperatures with a significant upper shelf energy value. The toughness values were also significantly higher than that obtained for the prior art TC 128 steel. Thus, the steel alloy plates of the inventive railroad tank cars successfully met the HAZ toughness requirements.

What is claimed is:

1. A railroad tank car formed of steel alloy plate, the alloy plate comprising a steel alloy including in wt. %:

C: 0.1-0.15; Mn: 1.3-1.5; Si: 0.15-0.40; Al: 0.015-0.06; Mo: 0.1-0.3; Ni: 0.1-0.25; Nb: 0.032; Ti: up to 0.02; Cr: up to 0.22; V: up to 0.08; Cu: up to 0.35; P: max 0.025; S: max 0.015; and N: 0.004-0.01, a balance being Fe;

the alloy plate having been normalized for at least 30 minutes at 900 degrees C.;

the alloy plate having a tensile strength of at least 580 MPa;

the alloy plate having a yield strength of at least 460 MPa;

the alloy plate having a total elongation of at least 33%;

the alloy plate having a CVN impact toughness of at least 156 J at −34.4 degrees C.;

the alloy plate having a CVN impact toughness of at least 128.8 J at −45.5 degrees C.; and the alloy plate having a ferrite-bainite microstructure with 10% or less pearlite.

2. The railroad tank car as recited in claim 1 wherein said ferrite-bainite microstructure has 5% or less pearlite.

3. The railroad tank car as recited in claim 1 wherein said ferrite-bainite microstructure has 1% or less pearlite.

4. The railroad tank car as recited in claim 1 wherein the alloy plate has been subjected to a post weld heat treatment of 30 to 60 mins at 600 to 650 degrees C.

5. The railroad tank car as recited in claim 1 wherein the alloy plate is 22 mm thick, and the ferrite-bainite microstructure consists of ferrite, bainite and optionally 10% or less pearlite.

6. The railroad tank car as recited in claim 5 wherein the alloy plate is normalized for 30 to 60 minutes at 900 degrees C.

7. The railroad tank car as recited in claim 5 wherein the alloy plate is normalized for 30 minutes at 900 degrees C.

8. The railroad tank car as recited in claim 7 wherein the alloy plate has been subjected to a post weld heat treatment of 30 to 60 mins at 600 to 650 degrees C.

9. A railroad tank car formed of a normalized and post weld heat treated (PWHT) steel alloy plate, the normalized and PWHT alloy plate comprising a steel alloy including in wt. %:

C: 0.1-0.15; Mn: 1.0-1.65; Si: 0.15-0.40; Al: 0.015-0.06; Mo: 0.1-0.3; Ni: 0.1-0.25; Nb: 0.032; Ti: up to 0.02; Cr: up to 0.22; V: up to 0.08; Cu: up to 0.35; P: max 0.025; S: max 0.015; and N: 0.004-0.01, a balance being Fe;

the normalized and PWHT alloy plate having a tensile strength of at least 580 MPa;

the normalized and PWHT alloy plate having a yield strength of at least 460 MPa;

the normalized and PWHT alloy plate having a total elongation of at least 33%;

the normalized and PWHT alloy plate having a CVN impact toughness of at least 156 J at −34.4 degrees C.;

the normalized and PWHT alloy plate having a CVN impact toughness of at least 128.8 J at −45.5 degrees C.; and the normalized and PWHT alloy plate having a ferrite-bainite microstructure with 10% or less pearlite.

10. The railroad tank car as recited in claim 9 wherein the normalized and PWHT alloy plate is an alloy plate that has been normalized for 30 to 60 minutes at 900 degrees C. and post weld heat treated of 30 to 60 mins at 600 to 650 degrees C.

11. The railroad tank car as recited in claim 9 wherein the normalized and PWHT alloy plate is 22 mm thick, and the ferrite-bainite microstructure consists of ferrite, bainite and optionally 10% or less pearlite.

* * * * *